US005601319A

United States Patent [19]

Morin

[11] Patent Number: 5,601,319

[45] Date of Patent: Feb. 11, 1997

[54] DOOR LOCKING DEVICE

[76] Inventor: Eugene W. Morin, 10906 202nd Ave. Northwest, Elk River, Minn. 55330

[21] Appl. No.: 412,467

[22] Filed: Mar. 29, 1995

[51] Int. Cl.[6] ..... E05C 1/06

[52] U.S. Cl. ..... 292/139; 292/339; 292/DIG. 15

[58] Field of Search ..... 292/338, 339, 292/DIG. 15, 139; 16/82

[56] References Cited

U.S. PATENT DOCUMENTS

| | | | |
|---|---|---|---|
| 476,910 | 6/1892 | Wells | 292/139 |
| 544,730 | 8/1895 | Kennedy | 292/338 |
| 559,382 | 5/1896 | Hoffman . | |
| 1,044,728 | 11/1912 | Basler . | |
| 1,238,042 | 8/1917 | Moore | 292/139 |
| 1,590,394 | 6/1926 | Rawlings . | |
| 2,123,188 | 7/1938 | Hurlbut | 292/139 X |
| 2,762,641 | 9/1956 | Gilmour | 292/63 |
| 3,731,341 | 5/1973 | Woodruff . | |
| 4,421,348 | 12/1983 | Kahn . | |
| 4,653,140 | 3/1987 | Hudec et al. . | |
| 4,673,203 | 6/1987 | Chezem | 292/339 |
| 5,098,138 | 3/1992 | Vandewege . | |
| 5,135,273 | 8/1992 | MacCalder . | |

FOREIGN PATENT DOCUMENTS

| | | | |
|---|---|---|---|
| 1380 | 3/1931 | Australia | 292/139 |
| 640198 | 5/1962 | Italy | 292/338 |
| 60411 | 3/1926 | Sweden | 292/139 |

OTHER PUBLICATIONS 3 pages from catalog entitled "The Word of Clamping" De–Sta–Co, A Dover Resources Mar. 1993.

*Primary Examiner*—Rodney M. Lindsey

*Attorney, Agent, or Firm*—Palmatier, Sjoquist, Helget & Voigt, P.A.

[57] ABSTRACT

According to the invention there is provided a security device for removable attachment to the bottom edge portion of a door to securely lock the door in a desired position. The device has a J-shaped bracket which confronts both sides of the door and extends underneath the door. An over-center linkage connected to a plunger and controlled by a handle provides a downward clamping effect engaging the floor surface. The plunger has an adjustable foot to accommodate various spacings between the door and floor surface. A supplemental sleeve on the plunger and a support post extending outwardly from the J-shaped bracket provides improved strength to the device.

18 Claims, 3 Drawing Sheets

DOOR LOCKING DEVICE

BACKGROUND OF THE INVENTION

This invention relates to security devices and, more particularly, it relates to a portable and removable door locking device.

The prior art shows several door security devices which are supplemental to the locks found on doors. These various supplemental security devices all suffer from various disadvantages that are overcome by the instant invention.

For example, U.S. Pat. No. 5,098,138 to Vandewege discloses a device with an elongate rod extending up to the proximity of the doorknob. In one embodiment, the device is attached by way of screws to the door. An alternative embodiment of the Vandewege patent shows the device clamped between the bottom of the door and the door knob. This device is relatively large in size and has a rather complicated wedge member utilized at the bottom of the door to stop the door from opening.

U.S. Pat. No. 4,421,348 to Kahn discloses a door guard with a folding locking member that opens to create a diagonal leg to prevent opening of the door. This patent discloses a separate detached foot piece that the diagonal leg may rest in. This device also has an upstanding leg which braces against the inside surface of the door with a lip which extends partially under the door. No particular means is provided to secure the upstanding leg to the door and therefore the security provided by this particular device is less than optimal. Moreover, the folding diagonal leg may be extended and placed on the floor or the friction pad without being placed under any particular amount of compression to secure the device in place. Moreover, the security of this device is extremely dependant upon the adhesion of the friction pad to a floor surface which will depend upon the amount of compression that the diagonal leg is under. Also, the Kahn invention does not disclose any adjustment means for taking into account different gaps between the doors and floor surfaces.

SUMMARY OF THE INVENTION

According to the invention there is provided a security device for removable attachment to the bottom edge portion of a door to securely lock the door in a desired position. The device has a J-shaped bracket which confronts both sides of the door and extends underneath the door. An over-center linkage connected to a plunger and controlled by a handle provides a downward clamping effect engaging the floor surface. The plunger has an adjustable foot to accommodate various spacings between the door and floor surface. A supplemental sleeve on the plunger and a support post extending outwardly from the J-shaped bracket provides improved strength to the device.

An object and advantage of the invention is that it may be adjusted for various spacings between different doors and floor surfaces.

An additional advantage and feature of the invention is that the handle provides a significant mechanical advantage to create a clamping force lifting upward on the door and downward against the floor surface to lock the door in place.

An additional object and advantage of the invention is that the upward force on the door is applied at the lower bottom edge of the door and thus will typically load the door against the entire upper door frame. Additionally, the upward force exerted by the J-shaped bracket on the lower portion of the door is not likely to cause any visible damage to the door. This is especially true since the surface that is subjected to the upward force is the bottom hidden portion of the door.

An additional object and advantage of the invention is that the device is extremely simple mechanically and yet provides an extremely secure locking effect for doors. Moreover, the device can be used with the door open as well as closed and the locking effect works in both directions, that is opening or shutting the door.

An additional advantage and feature of the invention is that the device may be positioned wherever desired laterally along the door.

Another advantage and feature of the invention is that it is very compact and portable and may be carried in an individual's luggage to hotel rooms and the like to provide a supplemental security device.

An additional object and advantage of the invention is that the J-shaped bracket extends to the outside surface of the door whereby it is visible to potential intruders, discouraging any attempted entrance.

An additional object and advantage of the invention is that a reinforcing member is provided to prevent bending and collapse the plunger with the footpad when the door is attempted to be pushed open with the locking device in the engagement position.

DETAILED DESCRIPTION OF THE PREFERRED EMBODIMENTS

Figure 1:
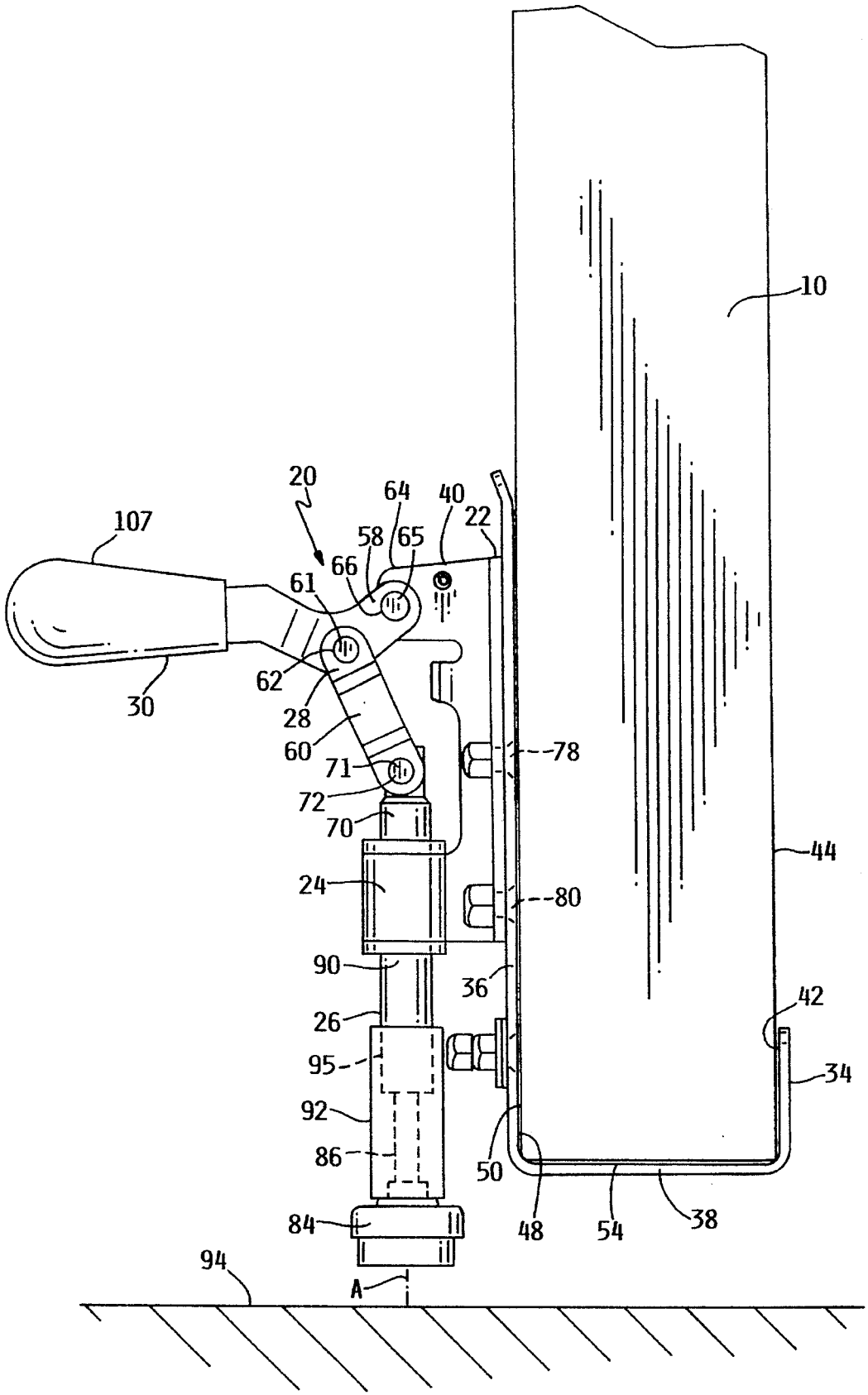
FIG. 1 is a side elevational view of a door with the removable door locking device in position on the bottom edge portion of the door.

Referring to FIG. 1, the removable locking device is shown in place on a door 10 with the device generally indicated by the numeral 20. The device is comprised principally of a J-shaped bracket 22 with a guide portion 24, a plunger 26 extending through the guide portion 24, a linkage 28 connected to the plunger 25, and a handle 30 to manipulate the linkage 28. The J-shaped bracket 22 is comprised of a first upright portion 34, a second upright portion 36, a horizontal portion 38 which joins the two upright portions 34, 36 and a clamp support structure 40. The upright portions 34, 36 and the horizontal portion 38 may be formed of a single piece of plate or sheet metal stock. The first upright portion 34 has a inside planar surface 42 which confronts and/or contacts a flat outside surface 44 of the door 10. Similarly, the second upright portion 36 has a planar surface 48 which confronts and or contacts the flat inside surface 50 of the door 10. The door 10 generally has a bottom edge portion 54 which the horizontal portion 38 contacts and presses against when the locking device is locked. The linkage 28 is comprised of a first link 58 and a second link 60 joined together by a pin 61 at a first pivot point 62. The first link 58 is pivotally attached to the J-shaped bracket 22 by way of a support member or post 64, which is part of the clamp support structure 40, and a pin 65 at a second pivot point 66. The second link 60 is pivotally attached to an upper portion 70 of the plunger 26 by a pin 71 at a third pivot point 72.

As indicated, the J-shaped bracket 22 also includes a clamp support structure 40 which is attached to the second upright portion 36 by way of screws 78, 80 or other suitable fastening devices. The clamp support structure 40 includes the guide portion 24 and the post 64. The plunger 26 is comprised of a foot portion 84 which is secured to a threaded shaft portion 86 which extends into a sliding portion 90 of the plunger 26. The plunger 26 is vertically moveable on the axis A. A sleeve 92 extends over the threaded shaft portion 86 and a lower portion 95 of the sliding portion 90 of the plunger 26. As shown in FIG. 1, the handle 30 is in a mid-range position and the foot portion 84 is confronting but not engaging the floor surface 94.

Figure 2:
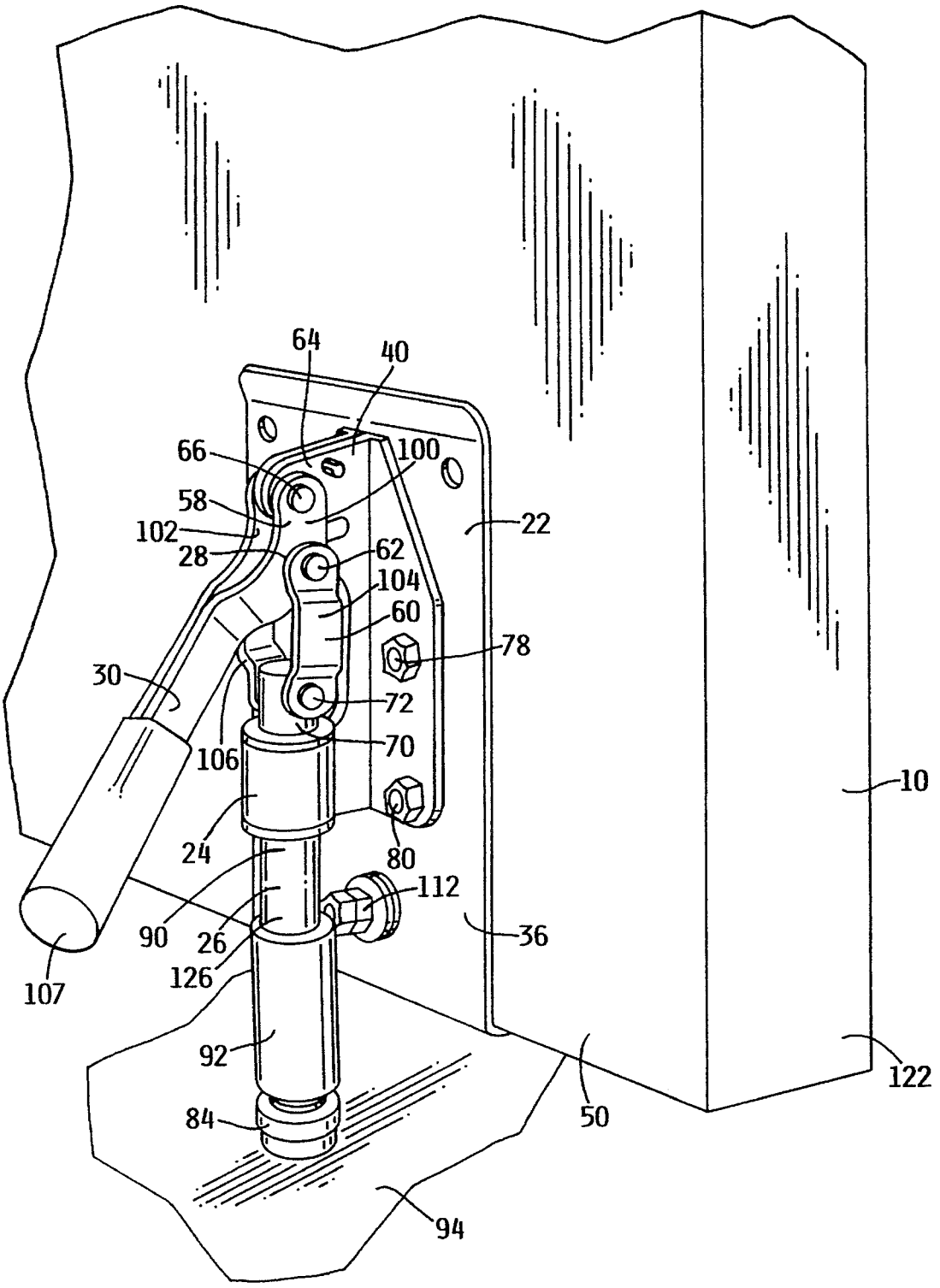
FIG. 2 is a perspective view of the device engaged with a door, with the handle down and with the plunger and foot in an extended position engaging the floor surface.

Referring to FIG. 2, a perspective view of the apparatus is shown engaged on the door 10 and the foot portion 84 engaging the floor surface 94. The linkage 28 is shown in an over-center position thus locking the plunger 26 in a fully extended position as shown. This view also shows that in this embodiment the first link 58, which is integral with the handle 30, has a first link right portion 100 and a first link left portion 102. Similarly, the second link has a second link right portion 104 and a second link left portion 106. The two portions of each link 58, 60 provide additional strength to the device.

Figure 3:
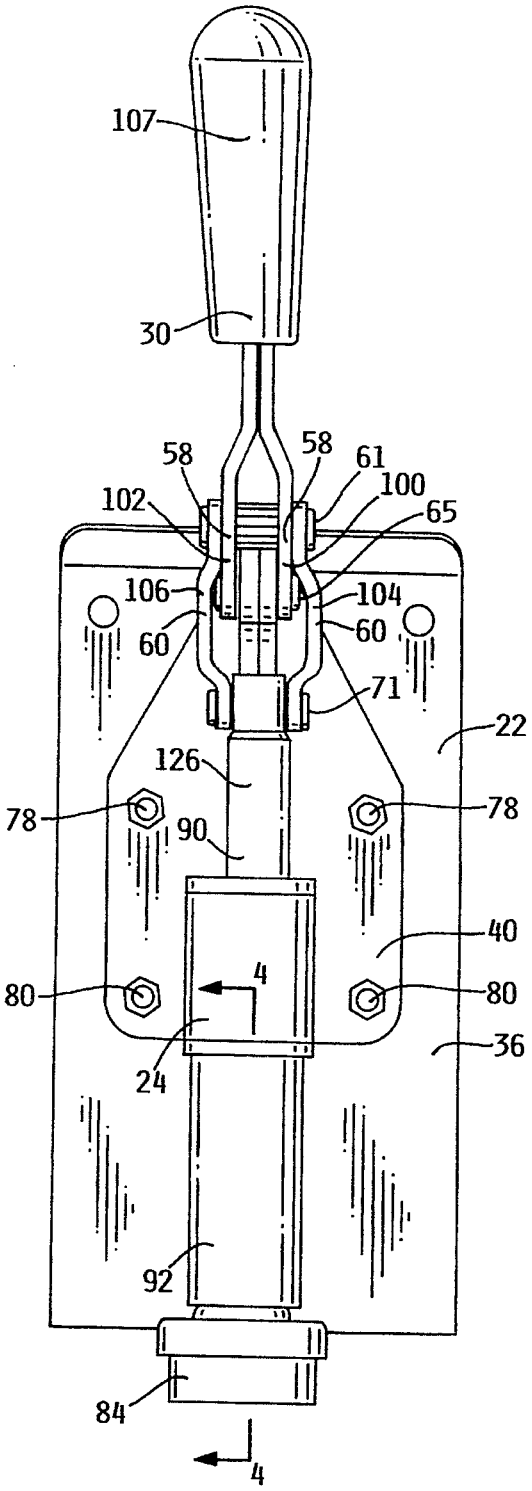
FIG. 3 is a front elevational view of the device with the handle in a full upright position and the plunger with the foot in a fully retracted position.

Referring to FIG. 3, the different link portions 100, 102, 104, 106 are shown from a front elevational view. The device has the handle 30 fully raised in this figure and thus the plunger 26 with the foot portion 84 is fully retracted. The linkage 28 in this position are thus in the most folded position. With the plunger 26 fully retracted, the sleeve 92 contacts the guide 24 and the foot portion 84. The handle 30 may have a molded plastic gripping member 107 as shown in the figures.

Figure 4:
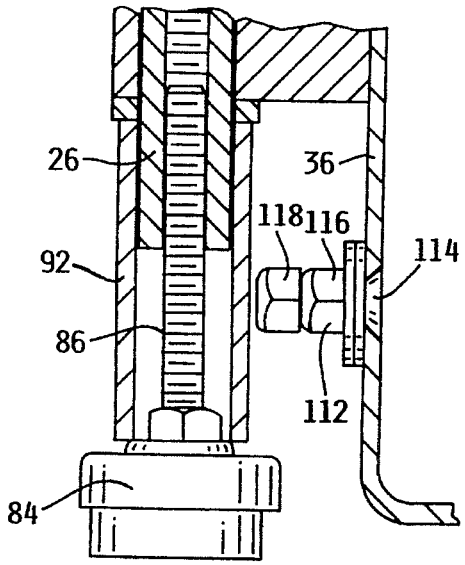
FIG. 4 is a cross-sectional detail view taken at line 4—4 of FIG. 3.

FIG. 4 shows a cross-sectional detail of the sleeve 92 and the plunger 26. A stop or support member 112 extends from the upright portion 36 to confront the sleeve 92. The stop 112 as portrayed may be a screw 114 and a pair of nuts 116, 118.

The device operates as follows. The handle 30 is placed in the fully upright position whereby the linkage 28 is in the fully folded position and the plunger 26 is in the fully retracted position. The door 10 is partially opened whereby the J-shaped bracket 22 may be slid under the lower or bottom edge portion 54 of the door 10 beginning at the right hand side 122 of the door 10. The door 10 is then shut with the device 20 still in place under the door. With the door shut the handle 20 is lowered to the point where the foot portion 84 contacts the floor surface 94. The foot portion 84 may be adjusted vertically so that it contacts the floor just before the linkage 58 reaches the position where the three connecting points 62, 66, 72 are in alignment, that is before the centered position. The handle 30 continues to be lowered whereby the foot portion 84 presses against the floor surface 94 and the horizontal portion 38 is thus pressed upwardly against the lower or bottom edge portion 54 of the door 10. The handle 30 is moved downwardly until the linkage 28 is in the over-center position as shown in FIG. 2 whereby the plunger 26 with the shoe is thus locked into the fully extended position. In this position the plunger 26 cannot be raised until the linkage 28 is released out of its over-center position by way the raising of the handle. The handle 30, linkage 28, plunger 90, and the bracket 22, including the clamp support structure 40 thus constitutes a clamp 126 extending between the door 10 and the floor surface 94. The floor surface 94 may be carpet or a hard surface. The foot portion 84 as portrayed in comprised of hard rubber but also may be formed of other material such as steel in applications where damage to the floor surface is not a factor.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. A removable locking device for placement between a door and a floor surface, the door having a bottom edge portion, the device comprising:

a) a J-shaped bracket for engaging the bottom edge portion of the door;

b) a substantially vertical plunger, the plunger slidably mounted to the J-shaped bracket, the plunger having a foot portion for frictionally engaging the floor surface;

c) a linkage having a first link and a second link the first link pivotally connected to the J-shaped bracket and pivotally connected to the second link, both said pivotal connections being about axes arranged to be parallel to an inside surface of the door, the second link pivotally connected to the plunger, the linkage having an over-center extended position and a folded position, whereby the plunger is moveable between a lower engagement position with the floor surface and an upward retracted position and whereby in the over-center extended position the linkage exerts a clamping force between the bottom edge portion of the door and the floor surface thereby locking the door in place and securing the J-shaped bracket at the bottom edge portion of the door; and d) a handle connected to the linkage for moving the linkage between the over-center position and the folded position.

2. The locking device of claim 1, wherein the plunger has a length and is further comprised of a sliding portion, and wherein the foot portion is threadably attached to the sliding portion and whereby the length of the plunger may be adjusted by rotating the foot portion with respect to the sliding portion.

3. The locking device of claim 1, wherein the J-shaped bracket has a guide portion and the substantially vertical plunger is slidably engaged to the J-shaped bracket through the guide portion.

4. The locking device of claim 2, wherein the foot portion has a threaded shaft portion and the sliding portion has a cooperating threaded bore.

5. The locking device of claim 4 further comprising a rigid sleeve extending over the threaded shaft portion and the sliding portion.

6. The locking device of claim 5 further comprising a support member extending from the J-shaped bracket and confronting the rigid sleeve.

7. The device of claim 1, wherein the door has a thickness, a flat inside surface, and a flat outside surface, and wherein the J-shaped bracket has a pair of inwardly facing planar surfaces sized to the thickness of the door for confronting the inside surface and the outside surface of the door.

8. The device of claim 1, wherein the handle is integral with the first link.

9. A removable locking device for placement between a door and a floor surface, the door having a thickness, an inside surface, an outside surface, and a bottom edge portion, the device comprising:

a) a bracket having a first upright portion, a second upright portion, and a horizontal portion joining the upright portions, the upright portions substantially spaced to the thickness of the door whereby the bracket is removably placeable along the bottom edge portion of the door;

b) a substantially vertical plunger, the plunger slidably mounted to the second upright portion of the bracket, the plunger having an adjustable foot portion for frictionally engaging the floor surface;

c) a handle connected to the bracket and to the plunger for moving the plunger between a lowered floor engaging position and an upward retracted position; and d) a linkage connected between the second upright portion and the plunger, the linkage having a first link and a second link the first link having one end pivotally connected with respect to the second upright portion of the bracket and an opposite end pivotally connected to a first end of the second link at a pivot point, both said pivotal connections being about axes arranged to be parallel to the inside surface of the door, the second link pivotally connected to the vertical plunger, the handle integral with the first link, the linkage having an extended over-center position whereby when the plunger is in the lowered floor engaging position the linkage in the over-center position exerts a clamping force between the floor surface and the bottom edge portion, the linkage also having a retracted position whereby the plunger is in the upward retracted position.

10. The locking device of claim 9, wherein the plunger has a length and is further comprised of a sliding portion, and wherein the foot portion is threadably attached to the sliding portion whereby the length of the plunger may be adjusted by rotating the foot portion with respect to the sliding portion.

11. The locking device of claim 10, wherein the bracket has a guide portion rigidly attached to the second upright portion and the substantially vertical plunger is slidably engaged to the second upright portion through the guide portion.

12. The locking device of claim 9, wherein the plunger has a threaded shaft portion and a sliding portion, the threaded shaft portion adjustably engaged with the sliding portion.

13. The locking device of claim 12 further comprising a rigid sleeve extending over the threaded shaft portion and the sliding portion.

14. The locking device of claim 13 further comprising a support member extending from the second upright portion and confronting the rigid sleeve.

15. A removable security device for placement between a door and a floor surface, the door having a thickness, an inside surface, an outside surface, and a bottom edge portion, the device comprising:

a) a bracket having a first upright portion, a second upright portion, and a horizontal portion joining the upright portions, the upright portions spaced to the thickness of the door whereby the bracket is removably placeable and slidable laterally at the bottom edge portion of the door;

b) a substantially vertical plunger and a handle connected to the plunger, the plunger slidably mounted to the second upright portion of the bracket, the plunger having a foot portion for frictionally engaging the floor surface, the plunger movable on a substantially vertical axis by way of the handle between an engagement position with the floor and a retracted disengaged position; and c) the handle pivotally connected to the second upright portion and pivotally connected to the plunger by a link, both said pivotal connections being about axes arranged to be parallel to the inside surface of the door, the link and the handle having an over-center extended position whereby when the link and the handle are in the over-center position a clamping force is provided between the bottom edge portion of the door and the floor surface whereby the plunger locked in the engagement position with the floor surface and whereby the bracket is locked into position on the bottom edge portion of the door.

16. The device of claim 15, wherein the first upright portion has a planar surface for engagement with the outside surface of the door and the second upright portion has a planar surface for engagement with the inside surface of the door.

17. The locking device of claim 16, wherein the plunger has a length and is further comprised of a sliding portion, and wherein the foot portion is threadably attached to the sliding portion whereby the length of the plunger may be adjusted by rotating the foot portion with respect to the sliding portion.

18. The locking device of claim 16, wherein the device has a guide portion rigidly attached to the second upright portion and the substantially vertical plunger is slidably engaged to the second upright portion through the guide portion.

* * * * *

UNITED STATES PATENT AND TRADEMARK OFFICE

CERTIFICATE OF CORRECTION

PATENT NO. : 5,601,319

DATED : February 11, 1997

INVENTOR(S) : Eugene W. Morin

It is certified that error appears in the above-indentified patent and that said Letters Patent is hereby corrected as shown below:

Column 6, line 30, please delete the word "plungerlocked" and insert in its place -- plunger is locked --

Signed and Sealed this

Twenty-second Day of July, 1997

Bruce Lehman

*Attest:*

BRUCE LEHMAN

*Attesting Officer*

*Commissioner of Patents and Trademarks*